United States Patent [19]

Kahan et al.

[11] 4,006,611

[45] Feb. 8, 1977

[54] POSITIONING CONTROL FOR PROGRAMMABLE KNITTING MACHINES

[75] Inventors: William Kahan, New York, N.Y.; Howard D. Rogers, Fanwood; Fredrick A. Rupinski, Lyndhurst, both of N.J.

[73] Assignee: The Singer Company, New York, N.Y.

[22] Filed: June 24, 1976

[21] Appl. No.: 699,734

Related U.S. Application Data

[63] Continuation-in-part of Ser. No. 612,815, Sept. 12, 1975, Pat. No. 3,983,718.

[52] U.S. Cl. ..... 66/75.2; 66/154 A

[51] Int. Cl.[2] ..... D04B 7/00; D04B 15/66

[58] Field of Search ..... 66/75 A, 154 A, 60, 66/64; 340/172.5; 235/151.11

[56] References Cited

UNITED STATES PATENTS

| | | | |
|---|---|---|---|
| 3,035,426 | 5/1962 | MacQueen et al. | 66/75 |
| 3,141,316 | 7/1964 | McCarthy et al. | 66/154 A |
| 3,783,642 | 1/1974 | Haddam | 66/75 A |
| 3,786,655 | 1/1974 | Krause | 66/154 A |
| 3,805,558 | 4/1974 | Protti | 66/154 A |
| 3,817,059 | 6/1974 | Krause | 66/154 A |
| 3,885,405 | 5/1975 | Bartels | 66/154 A |
| 3,896,297 | 7/1975 | Ploppa | 66/154 A |
| 3,896,638 | 7/1975 | Gottschall | 66/50 R |
| 3,913,353 | 10/1975 | Spencer | 66/75 A |
| 3,913,354 | 10/1975 | Kohler et al. | 66/154 A |
| 3,924,244 | 12/1975 | Morat | 66/154 A |

*Primary Examiner*—Ronald Feldbaum
*Attorney, Agent, or Firm*—Edward L. Bell; Robert E. Smith; William V. Ebs

[57] ABSTRACT

A home knitting machine is provided with a reader for reading out patterning instructions on a programmed card, an electronic memory for storing signals read from the card, means enabling an operator to select a needle to knit a particular column of a design unit and to thereby fix the overall position of a design in a width of fabric to be knit, and means for recalling the stored signals from the memory in synchronization with movement of the carriage during knitting and for causing the operations of needle selectors on the carriage in accordance with the recalled signals.

5 Claims, 7 Drawing Figures

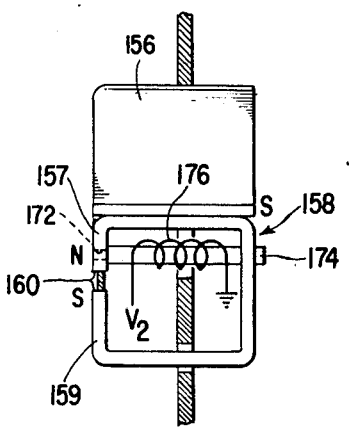
Fig. 7
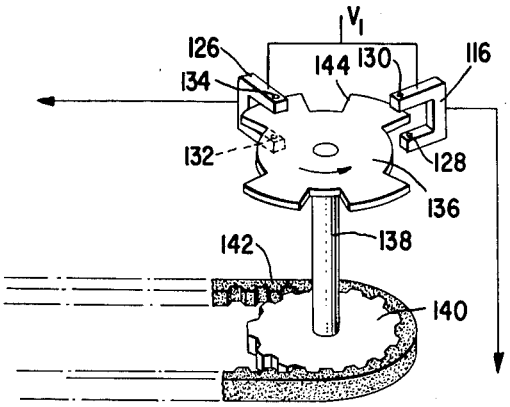
Fig. 4
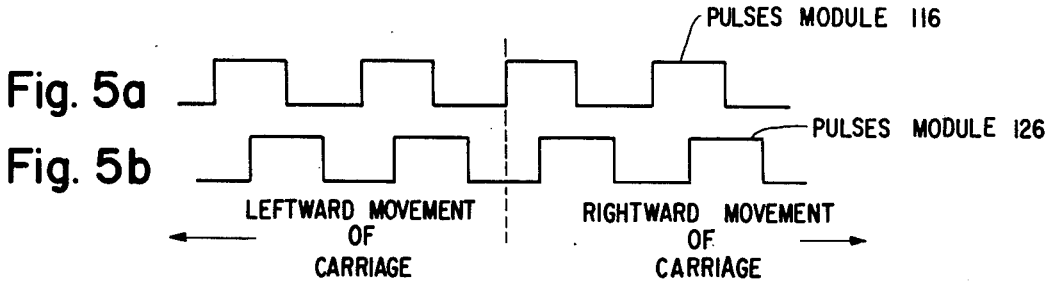
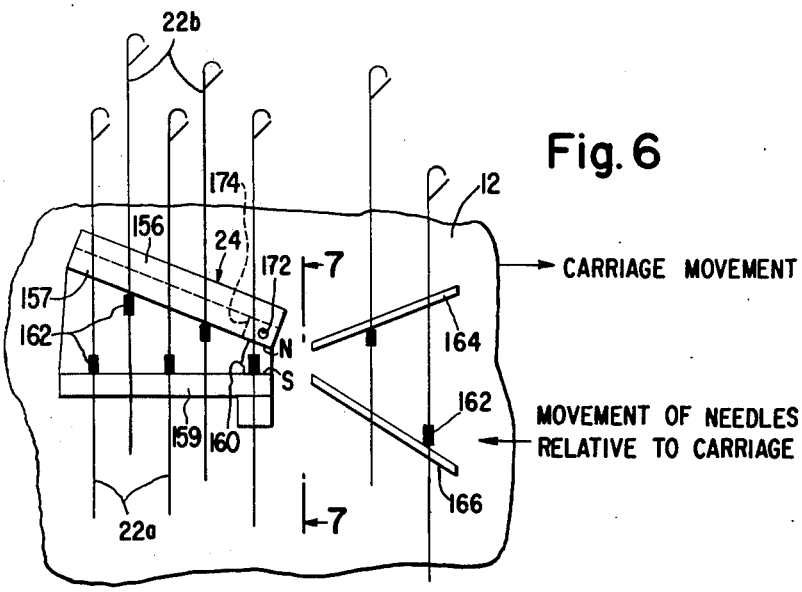
Fig. 6

POSITIONING CONTROL FOR PROGRAMMABLE KNITTING MACHINES

CROSS REFERENCE TO RELATED APPLICATIONS

This application is a continuation-in-part of the patent application of Kahan et al for "Knitting Machine for Producing Programmed Designs," Ser. No. 612,815, filed Sept. 12, 1975 now U.S. Pat. No. 3,983,718.

BACKGROUND OF THE INVENTION

1. Field of the Invention

The invention relates to flat bed knitting machines which can be programmed to produce prescribed designs in a fabric and has particular application to home knitting machines.

2. Description of the Prior Art

Programmable home knitting machines which pick up patterning instructions photoelectrically from a program card and utilize such instructions during the knitting of fabric as the carriage is moved back and forth across the needle bed of the machine are known and are exemplified by the machines of U.S. Pat. No. 3,885,405 and Japanese laid-open Patent 85853/73. It is a disadvantage of such machines that they do not include control means enabling an operator to readily select a needle at a chosen location in the bed of the machine to knit a particular column of a design unit and to thereby fix the horizontal position of the entire design within a width of fabric to be knit and it is a prime object of the invention to remedy such deficiency.

SUMMARY OF THE INVENTION

A home knitting machine according to the invention includes means for reading and memorizing patterning instructions on a program card. Fabric is knitted pursuant to the patterning instructions as signals representing such instructions are recalled from memory and used to control the operations of electromagnetic needle selectors on the carriage while the carriage is moved back and forth across the bed of the machine. Switch means connected with the memory and operable with the carriage over a selected needle enable an operator to precondition recall means and cause signals to be recalled from memory during knitting such that a particular column of a design unit is knitted by the selected needle and the overall design is thereby positioned accordingly in the fabric.

DESCRIPTION OF THE DRAWINGS

FIG. 4 is a schematic view in perspective of the pulse generator of said control system;

FIG. 5 (*a* and *b*) are diagrams showing the signal outputs of components of the pulse generator;

FIG. 6 is a somewhat schematic fragmentary bottom plan view of the carriage illustrating the operation of one of the needle selectors of the machine of the invention and;

FIG. 7 is a view taken on the plane of the line 7—7 of FIG. 6.

DESCRIPTION OF THE PREFERRED EMBODIMENT

Figure 1:
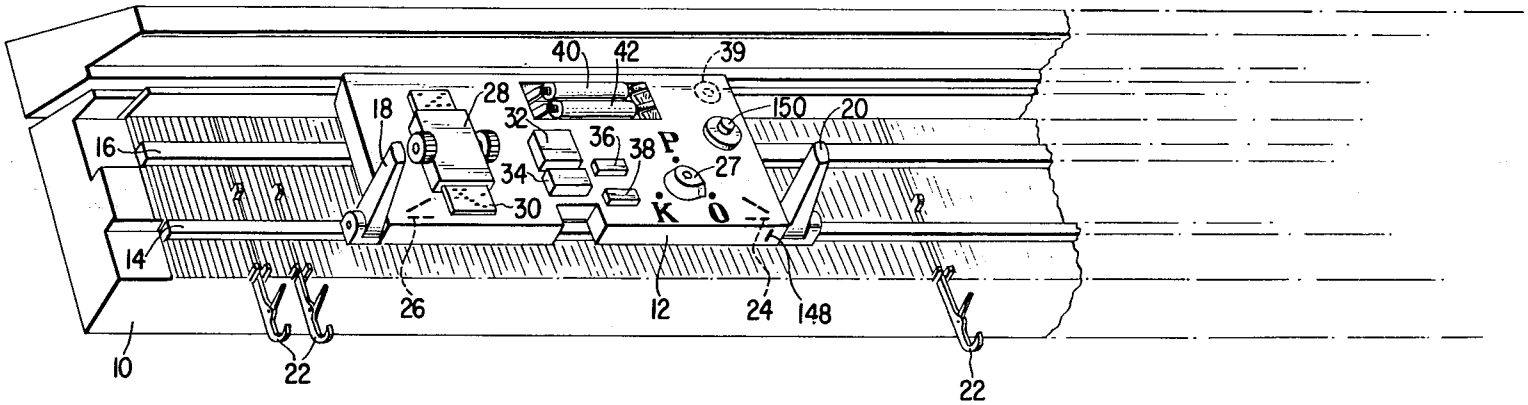
FIG. 1 is a perspective view of a home knitting machine according to the invention.

Referring to FIG. 1 of the drawings, reference characters 10 and 12 designate the bed and carriage respectively of the home knitting machine of the invention. The carriage is slidably mounted on guide rails 14 and 16 affixed to the bed, and includes handles 18 and 20 which an operator may grasp and utilize to move the carriage back and forth on the bed. Knitting needles 22 are supported in side by side relation in the bed 10 and are caused to follow a selected path through conventional camming in the carriage as determined by the operation of electromagnetic needle selectors 24 and 26. Such needles selectors are operated according to a prescribed design and the needles 22 being thereby caused to move along one path or another through the carriage camming selector either a base or a secondary yarn.

The needle selectors 24 and 26 are responsive to the operation of a control system which is wholly carried by the carriage 12 and includes a control switch 27 (OPK switch); a photoelectric reader 28 capable of detecting an entire design indicated on a program card 30 during one pass of the card through it; a silicon memory 32 capable of storing all of the patterning instructions read by the card; and sequencing control means including an up-down column counter 34 which regulates the admission and recall of signals to and from the memory, a row counter 36 and multiplexer 38 which regulate the recall of signals from the memory, and a pulse generator 39. The memory associated control components 34, 36 and 38 may be on separate silicon chips as shown or incorporated into a single chip with the memory. Batteries 40 and 42 may be utilized as the power supply for the control system and mounted on the carriage as shown to eliminate the necessity of providing power lines between a remote stationary power source and the movable carriage. The OPK switch 27 is a three position switch which an operator may move from a first position (O) in which the control system is turned off, to a second position (P) in which the system is conditioned for reading the program card 30 into the memory 32, from the second to a third position (K) in which the system is conditioned for knitting a programmed design, and from the third position back to the off position.

Figure 2:
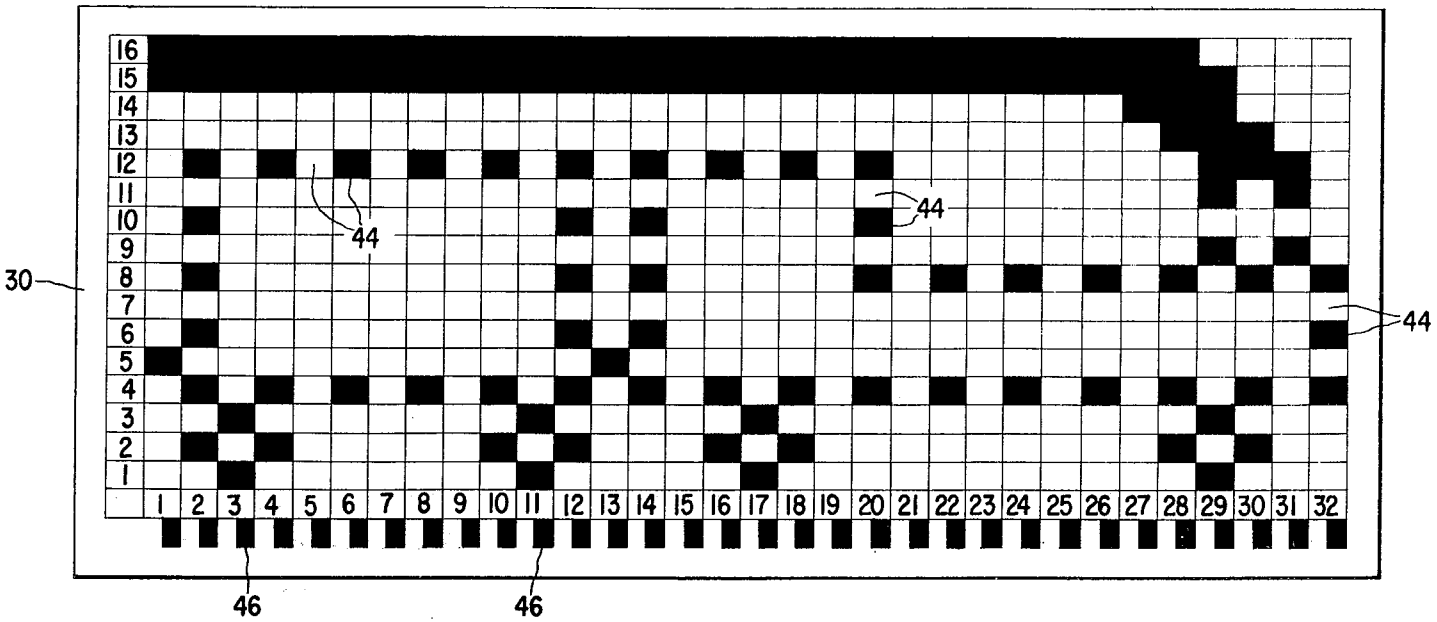
FIG. 2 is a plan view of a program card for use with the knitting machine.

The card which may be best seen in FIG. 2 is used to instruct the needle selector control system concerning a design which is to be produced on the knitting machine. As shown the card includes mutually perpendicular lines which define rectangles 44 that extend in numbered columns (1 through 32) and numbered rows (1 through 16). The card also includes a row of strobe markings 46 which are provided for a purpose hereinafter explained. An operator indicates the design unit he wishes produced, such as that shown in FIG. 2, by darkening selected ones of the rectangles 44 on the card with a pencil or other marker (preferably one leaving an erasable mark), and then feeds the card (left end first) through the reader.

Figure 3:
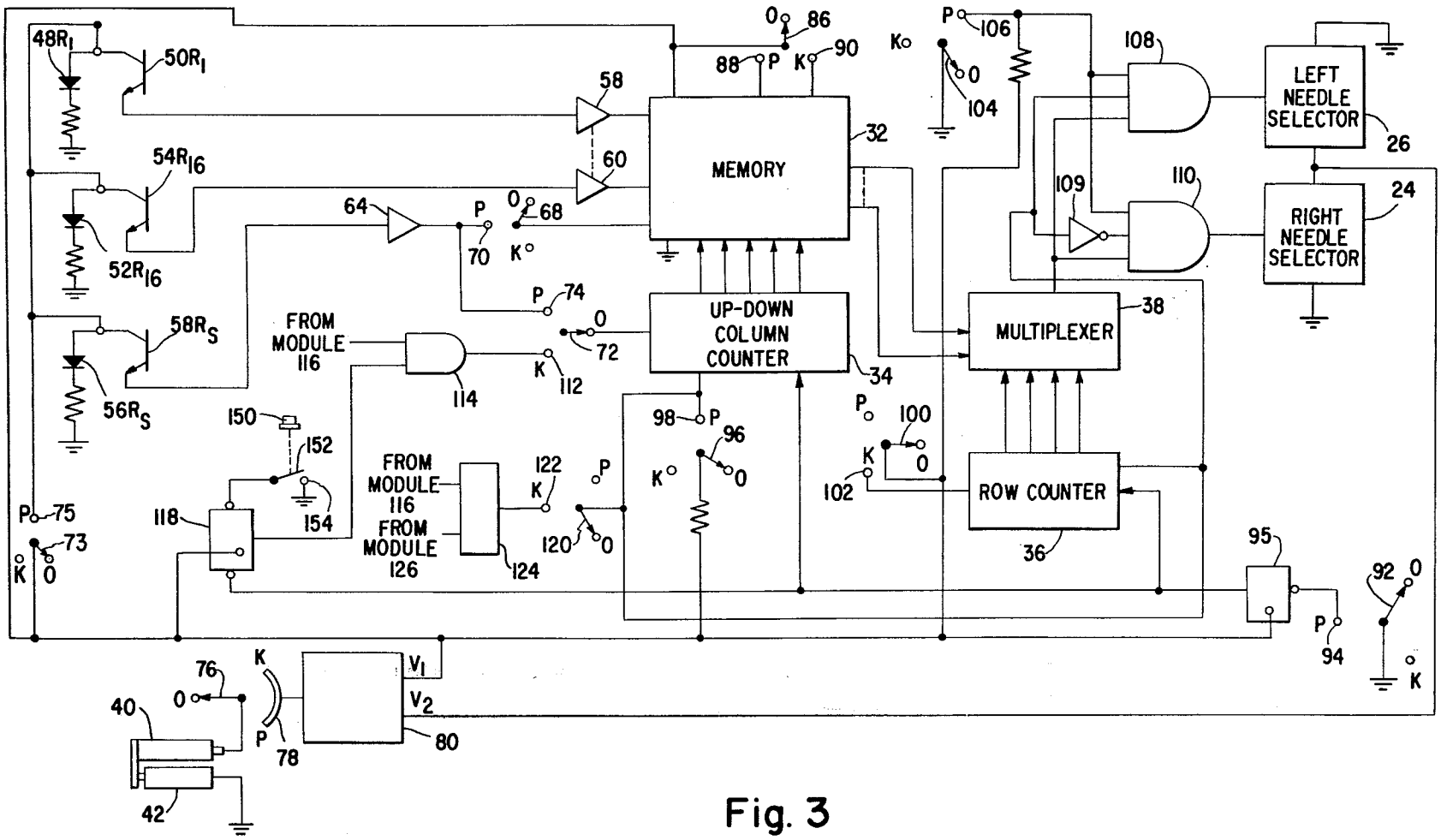
FIG. 3 is a block diagram showing components of the control system of the knitting machine of the invention and their interrelation.

The reader includes a paired light emitting diode (LED) and phototransistor for each of the numbered rows on the card and for the row of strobe markings 46. In FIG. 3 which shows the control system for the needle selectors 24 and 26, the LED — phototransistor pairs $48R_1 - 50R_1$, $52R_{16} - 54R_{16}$, and $56R_s - 58R_s$ have been illustrated for row 1, row 16 and the strobe markings respectively, and it is to be understood that like LED phototransistor pairs are included in the reader for each of rows 2 through 15. The LED — phototransistor pairs for the rows each connect with the memory 32 through amplifying means, as shown for the LED — phototransistors pairs $48R_1 - 50R_1$ and $52R_{16} - 54R_{16}$ at 58 and 60 respectively. The LED — phototransistor pair $56R_s - 58R_s$ connects through amplifying means 64 with the memory 32 and up-down counter 34 when the OPK switch 27, which controls the opening and closing of contacts 68 and 70 and of contacts 72 and 74 is in the program position. In any other position of the OPK switch, the LED — phototransistor pair $56R_s - 58R_s$ is disconnected from the memory 32 and from the up-down counter 34. Contacts 73 and 75 are closed by the OPK switch when the OPK switch is in the program position and contacts 76 and 78, the opening and closing of which is also controlled by OPK switch 27 are closed when the OPK switch is in either the program or knit position. Each of the LED-phototransistor pairs in the reader is therefore enabled when the OPK switch is in the program position, but not otherwise, by the output voltage $V_1$ of a voltage converter 80 which has as its potential source, the power supply of the control system, shown as the batteries 40 and 42. The memory 32 is also enabled by the voltage $V_1$ whenever contacts 76 and 78 are closed by reason of the OPK switch being in either the program or knit positions, but is not otherwise operable. The voltage converter in addition to providing the voltage $V_1$ also provides a voltage $V_2$ at a higher potential for operating the needle selectors 24 and 26. The OPK switch, when moved from the off to the program position closes contacts 86 and 88 to condition the memory for writing and when moved from the program to knit position closes contacts 86 and 90 to condition the memory for reading. Contacts 92 and 94 are also closed by the OPK switch when it is moved from the off to program position and as a consequence mono-stable multivibrator 95 (one shot) is caused to produce a voltage pulse which is then applied to up-down counter 34 and row counter 36 presetting them to column address 0 and row address 0 respectively. The OPK switch also closes contacts 96 and 98 when it is moved from the off to program position causing a directional signal to be applied to the counter, the signal being such as to cause the counter to count up.

With the OPK switch in the program position, the machine may be programmed to knit the particular design on the program card by feeding the card through the reader. The LED-phototransistor pairs in the reader are all arranged in a line and as a card moves through the reader the columns in the design area of the card, and the strobe markings, each of which is in alignment with the trailing half of a column, appear successively under the LED-phototransistor pairs. Phototransistor $58R_s$ detects the strobe marks and the other phototransistors detect the presence or absence of markings within the design area of the card. As previously noted the up-down counter 34 was set to address O when the OPK switch was moved from the off to the program position and readings from the first numbered column on the card are therefore recorded in the memory at this address when phototransistor $58R_s$ detects the first strobe mark, a write pulse being then applied to the memory over contacts 68 and 70. As the card moves through the reader, the counter is incremented by one each time the phototransistor moves beyond the trailing edge of a dark strobe mark to a light area and signals from the various columns are successively recorded as the dark strobe markings are detected causing a write pulse to be applied to the memory. The memory 32 is in the form of a semiconductor chip and is of a well known type of which Intel's P/N 2101, Signetics 2606 and the industry wide P/N 1103 are examples. The up-down counter 34 is also a semiconductor chip of a known type of which Texas Instruments Counter P/N 74191 is an example.

After the program card has been read, the OPK switch may be moved from the program to knit position to ready the machine for knitting. When the OPK switch is so moved it opens contacts 68 and 70 to disconnect the phototransistor $58R_s$ from the memory and opens contacts 72 and 74 disconnecting phototransistor $58R_s$ from the column counter 34. Contacts 100 and 102 which are open in the off and program positions of the OPK switch are closed thereby causing voltage $V_1$ to be applied as an enabling voltage to the row counter 36. Contacts 104 and 106 which are closed in the program position of the OPK switch and then cause a disabling voltage signal (ground potential) to be applied to AND gates 108 and 110 are opened when the OPK switch is moved to the knit position whereupon the disabling voltage signal is removed from the gates rendering the needle selectors operable. Contacts 72 and 112 are closed to connect the up-down counter to AND gate 114 which responds to signals from a photo-interrupter module 116 of the pulse generator 39 and a flip-flop 118, and contacts 120 and 122 are closed to connect the up-down counter and row counter to a flip-flop 124 which responds to signals from the aforesaid photo-interrupter module 116 and to a second photo-interrupter module 126 of the pulse generator.

The photo-interrupter modules of the pulse generator (See FIG. 4) each include a light emitting diode (LED) and phototransistor as shown for module 116 at 128 and 130 respectively, and for module 126 at 132 and 134 respectively, such LED's and phototransistors as shown being located on opposite sides of a toothed wheel 136 in the pulse generator. The toothed wheel 136 is affixed to a shaft 138 which is mechanically linked through a toothed pulley 140, also affixed to the shaft, and a timing belt 142 to gearing (not shown) as, for example, a pinion on the carriage and rack on the bed of the machine for driving the wheel as the carriage is moved across the bed. The wheel 136 moves in synchronism with the carriage and equally spaced teeth 144 on the wheel intermittently interrupt light between the LED and phototransistor in each of the photo-interrupter modules causing the modules to produce output pulses. Modules 116 and 126 are so located and the number of teeth 144 on wheel 136 is such as to cause module 116 to produce a counting pulse (FIG. 5*a*) each time the carriage passes from one needle area of the bed to the next, and module 126 to produce pulses (FIG. 5*b*) which lead the pulses from module 116 by 90° when the carriage is moved in one direction (to the right) and which lag the pulses from module 126 by 90° when the carriage is moved in the other direction (to the left). The output signal from module 116 controls the up-down counter 34 of FIG. 3, and the output signals from module 116 and 126 jointly control the operation of flip-flop 124 and so cause the flip-flop to provide an output signal indicative of the direction of movement of the carriage.

With the machine readied for knitting an operator chooses one of the needles in the bed to initially knit the design fragment indicated by the presence or absence of a mark in column 1, row 1, on the program card and subsequentially also the rest of the design in column 1. This is accomplished by the operator positioning the carriage so that the right needle selector may act first upon the chosen needle during knitting (the appropriate position being defined by the alignment of a mark 148 on the carriage with the said needle), and by the operator then depressing button 150 on the carriage to momentarily close contacts 152 and 154 (See FIGS. 1 and 3). The closing of contacts 152 and 154 sets flip-flop 118 which then provides an input to gate 114 permitting the up-down counter to be incremented or decremented in response to the operation of photo-interpreter module 116.

The machine is threaded with a secondary yarn as required for knitting the design pattern in a base yarn previously cast on the machine and the carriage is moved first to the right and then back and forth across the bed to repetitively knit the design unit on the card into a larger overall design located with respect to the needles of the machine according to the needle selected by the operation of button 150 to knit column 1 of the design unit. Initially column 1 information is read out of the memory since the up-down counter is at address O when button 150 is depressed (the counter having been so set when the OPK switch was moved from the off to program position closing contacts 92 and 94), and row 1 is selected by the row counter 36 and multiplexer 38 since the row counter is then also at 0. As the carriage is moved to the right on the bed beyond the chosen needle, up-down counter 34 responding to the operation of module 116 is incremented once each time the carriage moves over a new needle location. The counter is thereby caused to sequentially address the 32 columns of information in the memory and after each 32 counts repeat the process. Such column information is read into the multiplexer and the multiplexer which is at address 0 selects from each column the information in row one. During the said first knitting stroke of the carriage to the right a directional signal from flip-flop 124 directly transmitted to the gate 108 and through an inverter 109 to gate 110 causes the right needle selector 24 to be operated in response to signals from the multiplexer to the gates but prevents the operation of the left needle selector.

After the carriage has been moved beyond the fabric being knitted the operator reverses its direction causing it to be moved to the left whereupon the row counter is incremented by one and the up-down counter is caused to count down rather than up, both changes being effected in response to a changed directional signal from flip-flop 124. The up-down counter is decremented by one count as each needle location is traversed by the carriage, the column information is extracted from the memory in reverse order sequentially and repetitively, and the multiplexer because of the changed row selects the information in row 2 of each of the columns. By reason of the changed directional signal at flip-flop 124 which is reflected at gates 108 and 110, the left needle selector is caused to operate in response to output signals of the multiplexer transmitted to the gates and the right needle selector is prevented from operating. As the carriage moves to the left such left needle selector is operated to cause that portion of the design unit appearing in the second row on the program card to be knitted repetitively across the fabric. Successive rows of the design are formed in successive courses of the fabric knitted on the machine as the carriage is moved back and forth across the machine bed. Sixteen rows of design are produced in as many courses of fabric and the entire design is reknitted each time 16 courses have been completed, such repetition being controlled by the row counter which counts up to 16 and then repeats such counting process. The row counter 36 is a semiconductor chip and is similar to the column counter 34 but lacks the up-down feature. An example of a suitable row counter is Texas Instruments counter P/N 74161.

The needle selectors 24 and 26 are without moving parts and rely solely on magnetic force to influence the positions of needles. Other types of needle selectors having moving parts that actuate needles and so influence their position might be used instead. The needle selectors 24 and 26, both of which are alike, function during movement to the right and left, respectively, of the carriage in a manner made apparent in FIGS. 6 and 7. The selector 24 includes a permanent magnet 156 fastened against the upper limb 157 of a C-shaped channel 158 of magnetic material having a lower limb 159. The upper and lower limb 157 and 159 of the channel 158 define a gap 160 which diverges toward the left as shown in FIG. 7 and presents opposing north and south magnetic poles as indicated. Needle butts 162 move through the selector as the carriage is moved on the bed of the machine and are caused by guides 164 and 166 to pass into the narrowest portions of the gap 160. A hole 172 is formed in the limb 157 adjacent to the narrowest portion of the gap 160 which so reduces the strength of the upper or north pole of the opposed magnetic poles developed solely by the permanent magnet 156 that needle butts guided into the gap 160 will be attracted to the lower or south pole against limb 159 and thereafter continue along limb 159 (needles **22*a***) because of the separation caused by the divergence of the pole faces.

A magnetizable core 174 is attached to the upper limb 157 of the channel 158 adjacent to the hole 172 and a coil 176 is so arranged on the core 174 that when the coil is energized a strong electro-magnetic pole is produced on the core 174 of the same polarity as that produced by the permanent magnet 156 in the gap 160. When a needle butt is in the gap while the coil 176 is energized, the upper or North magnetic pole of the opposed magnetic poles in the gap will be the strongest pole and will attract that needle butt against the upper limb 157 and it will continue along the upper limb (needles **22*b***) because of the separation caused by the divergence of the pole faces.

Numerous alterations of the structure herein disclosed will suggest themselves to those skilled in the art and it is to be understood that the present disclosure relates to an embodiment of the invention which is for purposes of illustration only. It is not to be construed as a limitation of the invention. All modifications which do not depart from the spirit of the invention are intended to be included within the scope of the appended claims.

Having thus set forth the nature of the invention, what is claimed herein is:

1. In a knitting machine, the combination comprising a needle bed supporting a plurality of needles in side by side relation, a carriage mounted on the bed for movement traversing such needles, a program card bearing patterning instructions in rows and columns to denote a design unit to be produced in courses and wales respectively of a fabric, means for reading out the patterning instructions on the card, a memory connected with the reading means for storing signals representing the patterning instructions, needle selecting means on the carriage operably connected with the memory, means for sequentially recalling signals from the memory as the carriage is moved back and forth across the bed of the machine and operating said selecting means such that the design unit may be repetitively produced across a fabric, and switch means operable to precondition the recall means with the carriage in a selected position to provide for the formation of a particular column of the design unit on a particular needle whereby the locations for repetitively produced design units in a width of said fabric is established.

2. The combination of claim 1 wherein a defined location on the carriage is in alignment with said particular needle in the selected position of the carriage.

3. The combination of claim 1 wherein the switch means is located on the carriage of the machine.

4. In a knitting machine, the combination comprising a needle bed supporting a plurality of needles in side by side relation, a carriage mounted on the bed for movement traversing such needles, a program card bearing patterning instructions in rows and columns to denote a design unit to be produced in courses and wales respectively of a fabric, means for reading patterning instructions on the card, a memory connected with the reading means for storing signals representing the patterning instructions, needle selecting means on the carriage operably connected with the memory, sequencing control means including a pulse generator on the carriage operable in timed relation to movement of the carriage for recalling signals from the memory whereby they may be utilized to control the operation of the needle selecting means when the carriage is moved on the bed of the machine for the purpose of knitting fabric, and switch means operable to choose a particular needle defined by a selected position of the carriage on the bed for a particular column of the design unit, the switch means when operated being effective to cause the sequencing means to select from memory a signal corresponding to a first patterning instruction in said column, and said sequencing means being operable in response to movement of the carriage from the needle defining position such that when knitting, the design unit may be produced repetitively across the fabric in positions consistent with said first and the remaining patterning instructions in said particular column being executed on the chosen needle.

5. In a knitting machine, the combination comprising a needle bed supporting a plurality of needles in side by side relation, a carriage mounted on the bed for movement traversing such needles, a program card bearing patterning instructions in rows and columns to denote a design unit to be produced in courses and wales respectively of a fabric, means for reading out the patterning instructions on the card, a memory connected with the reading means for storing signals representing the patterning instructions, needle selecting means on the carriage operably connected with the memory, means for sequentially recalling signals from the memory as the carriage is moved back and forth across the bed of the machine and operating said selecting means such that the design unit may be repetitively produced across a fabric, and switch means operable to precondition the recall means to provide for the formation of a particular column of the design unit on a particular needle whereby the locations for repetitively produced design units in a width of said fabric is established.

* * * * *